US010103505B1

(12) United States Patent
Izaki et al.

(10) Patent No.: US 10,103,505 B1
(45) Date of Patent: Oct. 16, 2018

(54) CABLE WITH CONNECTORS

(71) Applicant: SUMITOMO ELECTRIC INDUSTRIES, LTD., Osaka-shi, Osaka (JP)

(72) Inventors: Manabu Izaki, Yokohama (JP); Isao Saito, Yokohama (JP); Shintaro Mouri, Yokohama (JP)

(73) Assignee: SUMITOMO ELECTRIC INDUSTRIES, LTD., Osaka-shi, Osaka (JP)

( * ) Notice: Subject to any disclaimer, the term of this patent is extended or adjusted under 35 U.S.C. 154(b) by 0 days.

(21) Appl. No.: 15/474,148

(22) Filed: Mar. 30, 2017

(51) Int. Cl.
*H01R 25/00* (2006.01)
*H01R 24/60* (2011.01)
*H01R 107/00* (2006.01)

(52) U.S. Cl.
CPC ..... *H01R 25/003* (2013.01); *H01R 24/60* (2013.01); *H01R 2107/00* (2013.01)

(58) Field of Classification Search
CPC ..... H01R 24/60
See application file for complete search history.

(56) References Cited

U.S. PATENT DOCUMENTS

2016/0365673 A1* 12/2016 Liang ..... H01R 12/57
2017/0194754 A1* 7/2017 Tsai ..... H01R 24/60
2017/0207589 A1* 7/2017 Wu ..... H01R 24/60

FOREIGN PATENT DOCUMENTS

JP A-2005-025971 1/2005
JP 2013-206612 A 10/2013

* cited by examiner

*Primary Examiner* — Ross Gushi
(74) *Attorney, Agent, or Firm* — Drinker Biddle & Reath LLP

(57) ABSTRACT

A cable with connectors includes a plurality of electric wires arranged in parallel, and a first connector and a second connector provided at each end of the electric wires. The first connector includes a first substrate accommodated therein and a connector plug connected to the first substrate. The second connector includes a second substrate accommodated therein and a connector plug connected to the second substrate. The first substrate and the second substrate have a plurality of first contact points arranged at one end-side thereof and to be connected with the electric wires, respectively. The plurality of first contact points is arranged so that am arrangement order of the plurality of first contact points provided on the first substrate and an arrangement order of the plurality of first contact points provided on the second substrate are mirror-symmetric with the electric wires being interposed therebetween.

6 Claims, 6 Drawing Sheets

CABLE WITH CONNECTORS

BACKGROUND

Technical Field

The invention relates to a cable with connectors including a plurality of electric wires and connector substrates attached to both ends of the plurality of electric wires.

Related Art

Patent Document 1 discloses a cable having a plurality of electric wires and connector substrates having the same shape and attached to both ends of the plurality of electric wires. The plurality of electric wires is divided into a first group connected to first surface-side connection terminals of the connector substrate and a second group connected to back surface-side connection terminals of the connector substrate. The electric wires of the first group and the electric wires of the second group intersect with each other at one end portion of the cable and are attached to the connector substrate.

[Patent Document 1] Japanese Patent Application Publication No. 2013-206612A

In Patent Document 1, in order to attach the connector substrates having the same shape to both ends of the electric wires, it is necessary to intersect the electric wires of the first group and the electric wires of the second group at one end portion of the cable. Therefore, it is necessary to perform a process of intersecting the electric wires, which lowers the productivity. Also, when the electric wires of the first group and the electric wires of the second group are made to intersect with each other, wire lengths may be different between the electric wires. When differential signal is transmitted on an electric wire pair in which the two electric wires having the different wire lengths set as one pair, skew is generated in the electric wire pair.

SUMMARY

Exemplary embodiments of the invention provide a cable with connectors, which can be easily manufactured, the productivity thereof is improved and skew is scarcely generated therein.

A cable with connectors according to an exemplary embodiment, comprises:

a plurality of electric wires arranged in parallel; and a first connector and a second connector provided at each end of the plurality of electric wires, respectively, wherein the first connector comprises a first substrate accommodated therein and a connector plug connected to the first substrate, wherein the second connector comprises a second substrate accommodated therein and a connector plug connected to the second substrate, wherein the first substrate and the second substrate have a plurality of first contact points arranged at one end-side thereof and to be connected with the plurality of electric wires, respectively, and wherein the plurality of first contact points is arranged so that an arrangement order of the plurality of first contact points provided on the first substrate and an arrangement order of the plurality of first contact points provided on the second substrate are mirror-symmetric with the plurality of electric wires being interposed therebetween.

According to the disclosure, it is possible to provide the cable with connectors, which can be easily manufactured, the productivity thereof is improved and skew is scarcely generated therein.

DETAILED DESCRIPTION

<Outline of Exemplary Embodiment of Invention>

Figure 1:
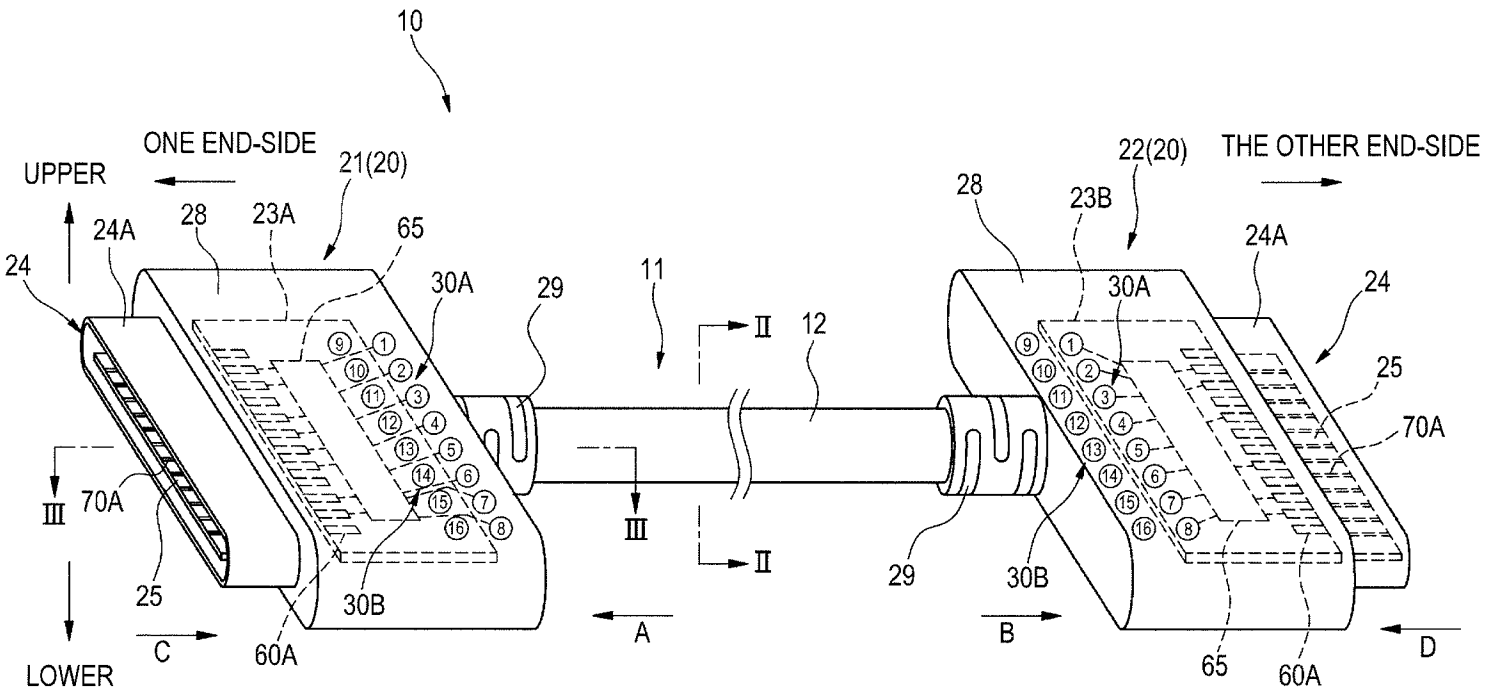
FIG. 1 is a perspective view depicting an example of a cable with connectors in accordance with an exemplary embodiment of the invention.

First, an outline of an exemplary embodiment of the invention is described.

(1) A cable with connectors according to an exemplary embodiment comprises:

a plurality of electric wires arranged in parallel; and a first connector and a second connector provided at each end of the plurality of electric wires, respectively, wherein the first connector comprises a first substrate accommodated therein and a connector plug connected to the first substrate, wherein the second connector comprises a second substrate accommodated therein and a connector plug connected to the second substrate, wherein the first substrate and the second substrate have a plurality of first contact points arranged at one end-side thereof and to be connected with the plurality of electric wires, respectively, and wherein the plurality of first contact points is arranged so that an arrangement order of the plurality of first contact points provided on the first substrate and an arrangement order of the plurality of first contact points provided on the second substrate are mirror-symmetric with the plurality of electric wires being interposed therebetween.

According to the configuration of the exemplary embodiment, it is possible to connect both ends of a plurality of electric wires to a plurality of first contact points provided for a first substrate of a first connector and a plurality of first contact points provided for a second substrate of a second connector, without intersecting the plurality of electric wires. For this reason, it is possible to provide a cable with connectors capable of being easily manufactured and having excellent productivity. Also, since there is no wire length difference between the plurality of electric wires, it is possible to prevent skew from being generated in an electric wire pair configured to perform differential signal transmission.

(2) It is preferable that the first substrate and the second substrate have a plurality of second contact points arranged at the other end-side thereof and to be connected with a plurality of contact pins provided for the connector plugs, respectively, that the plurality of first contact points and the plurality of second contact points are coupled therebetween by an electric circuit, and that when the first substrate and the second substrate are seen from sides opposite to sides to which the plurality of electric wires is to be connected, the plurality of second contact points is arranged so that an arrangement order of the plurality of second contact points of the first substrate and an arrangement order of the plurality of second contact points of the second substrate are the same.

According to the configuration, it is possible to use the same connector plug, which is respectively connected to the first substrate and the second substrate, so that it is possible to connect the first connector and the second connector to a receptacle of an electronic device, without distinction of one end-side and the other end-side.

(3) It is preferable that the plurality of electric wires comprises high-speed differential signal wires configured to transmit and receive a high-speed differential signal and single-ended signal wires configured to transmit and receive a single-ended signal, and the single-ended signal wires are connected to a part of the first contact points, which are arranged on a surface of the first substrate and on a surface of the second substrate, and the high-speed differential signal wires are connected to the rest of the first contact points arranged on the other surface of the first substrate and on the other surface of the second substrate.

According to the configuration, it is possible to connect the connector to a receptacle without distinguishing a top or a bottom of the connector.

(4) It is preferable that the first contact points arranged on the other surface and connected to the high-speed differential signal wires comprise at least three contact point pairs, the plurality of second contact points comprises contact points for single-ended signal to be connected to the single-ended signal wires and contact points for high-speed signal to be connected to the high-speed differential signal wires, and two contact point pairs of both ends of the at least three contact point pairs are coupled with the contact points for high-speed signal, which are arranged on a surface or the other surface of the first substrate and the second substrate, via an electric circuit, at least one contact point pair sandwiched between the contact point pairs of both ends is coupled with the contact points for high-speed signal arranged on a surface opposite to a surface on which the contact points for high-speed signal connected to the contact point pairs of both ends are arranged, via the electric circuit.

According to the configuration, it is possible to connect the connector to a receptacle without distinguishing a top or bottom of the connector, and to narrow a width of the connector.

(5) It is preferable that the plurality of contact points for high-speed signal configures pairs in correspondence to the contact point pairs of the first contact points and the contact points for single-ended signal are sandwiched between the pairs of the contact points for high-speed signal.

According to the configuration, it is possible to suppress crosstalk of a high-speed signal.

(6) It is preferable that the high-speed differential signal wires are coaxial electric wires.

According to the configuration, it is possible to make the cable flexible.

<Details of Exemplary Embodiment of Invention>

Hereinafter, an exemplary embodiment of a cable with connectors in accordance with the invention will be described with reference to the drawings.

FIG. 1 is a perspective view depicting an example of a cable 10 having connectors. As shown in FIG. 1, the cable 10 having connectors can be used to connect electronic devices (not shown) each other, for example, and has a first connector 21 and a second connector 22 as connectors 20 connected to both ends of a cable 11. The first connector 21 is attached to an end portion (a left end in FIG. 1) of one end-side of the cable 11, and the second connector 22 is attached to an end portion (a right end in FIG. 1) of the other end-side of the cable 11.

An upper side in FIG. 1 is referred to as upper surfaces of the first connector 21 and the second connector 22, and an opposite side thereto is referred to as lower surfaces.

The first connector 21 has therein a first substrate 23A having a flat plate shape. Also, the second connector 22 has therein a second substrate 23B having a flat plate shape. Each of the first substrate 23A and the second substrate 23B has a plurality of connection terminals (an example of first contact points) 30A, 30B arranged on upper and lower surfaces of the first substrate 23A and the second substrate 23B at an end portion thereof facing toward the cable 11. Also, each of the first substrate 23A and the second substrate 23B has a plurality of connection terminals (an example of second contact points) 60A, 60B (refer to FIGS. 3, 5A and 5B) arranged on the upper and lower surfaces at an end portion thereof opposite to the cable 11-side.

A connector plug 24 is arranged at one end-side of the first connector 21. As a housing of the connector plug 24, a metallic shell 24A having a substantially long cylindrical shape is provided. In the metallic shell 24A, a pin holding plate 25 is accommodated. The pin holding plate 25 is a member configured to hold contact pins 70A to be connected to contact pins in a receptacle (not shown) of an electronic device-side. Also, a connector plug 24 is arranged at the other end-side of the second connector 22. As a housing of the connector plug 24, a metallic shell 24A having a substantially long cylindrical shape is provided. In the metallic shell 24A, a pin holding plate 25 is accommodated. The pin holding plate 25 is a member configured to hold contact pins 70A to be connected to contact pins in a receptacle (not shown) of an electronic device-side. As described later, in the exemplary embodiment, the connector plug 24 of the first connector 21 and the connector plug 24 of the second connector 22 have the same shape and configuration.

Figure 2A:
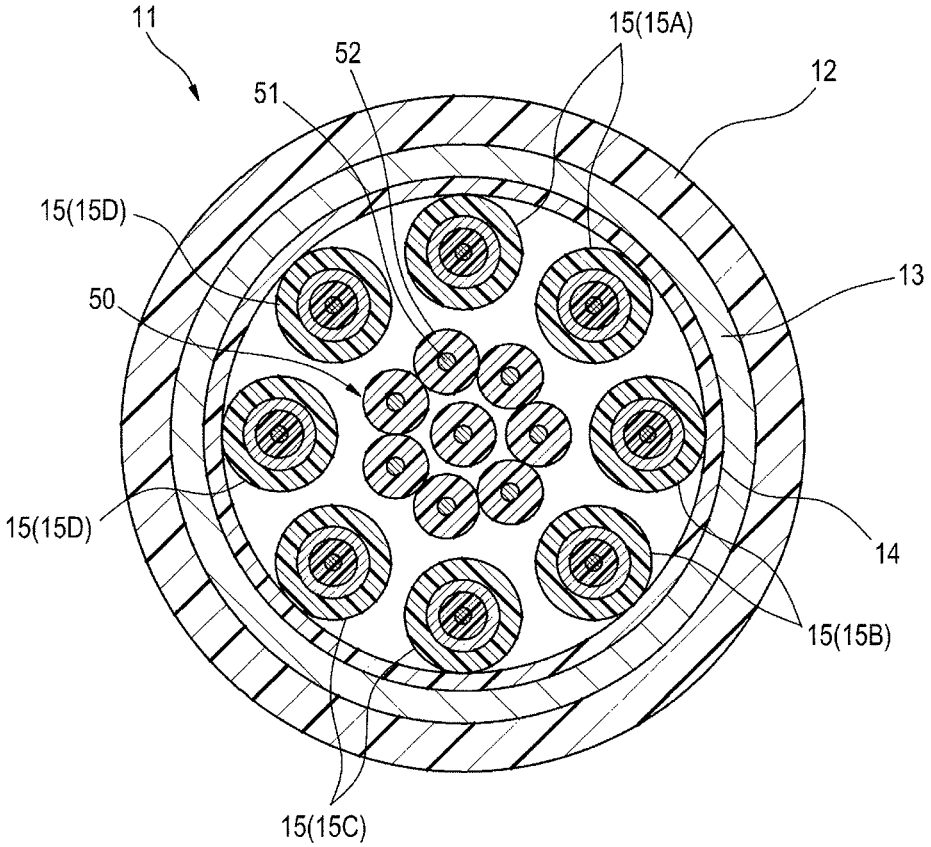
FIG. 2A is a sectional view taken along a line II-II of the cable with connectors shown in FIG. 1.
Figure 2B:
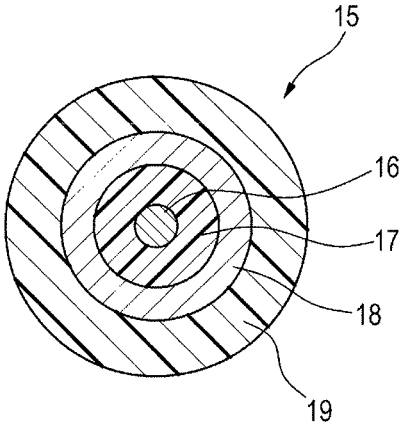
FIG. 2B is an enlarged sectional view of a coaxial electric wire shown in FIG. 2A.

FIG. 2A is a sectional view taken along a line II-II of the cable 11 shown in FIG. 1, and FIG. 2B is an enlarged sectional view of a coaxial electric wire 15 shown in FIG. 2A. As shown in FIG. 2A, as the cable 11, a cable including eight insulated electric wires 50 arranged at a center, eight coaxial electric wires 15 arranged around the insulated electric wires, a pressing tape 14 made of a tape material (for example, paper or polyester), a shield (braid) 13 made of braid of a metallic strand (for example, tin-plated annealed copper wire) and a sheath 12 made of polyvinyl chloride can be adopted. In the exemplary embodiment, the insulated electric wire 50 is a single-ended signal wire configured to transmit and receive a single-ended signal (signal that can be transmitted by a single wire) and has a central conductor 51 and a jacket 52 configured to cover the central conductor 51.

In the exemplary embodiment, the coaxial electric wire 15 is a high-speed differential signal wire configuring a pair by two wires and is configured to transmit and receive a high-speed differential signal. As a coaxial electric wire pair configured by a pair of the coaxial electric wires 15, four coaxial electric wire pairs 15A, 15B, 15C, 15D are accommodated in the cable 11, in the exemplary embodiment. As shown in FIG. 2B, each coaxial electric wire 15 has a central conductor 16, an insulator 17 configured to cover the central conductor 16, an external conductor 18 arranged on an outer side of the insulator 17 and a jacket 19 configured to cover the external conductor 18.

Figure 3:
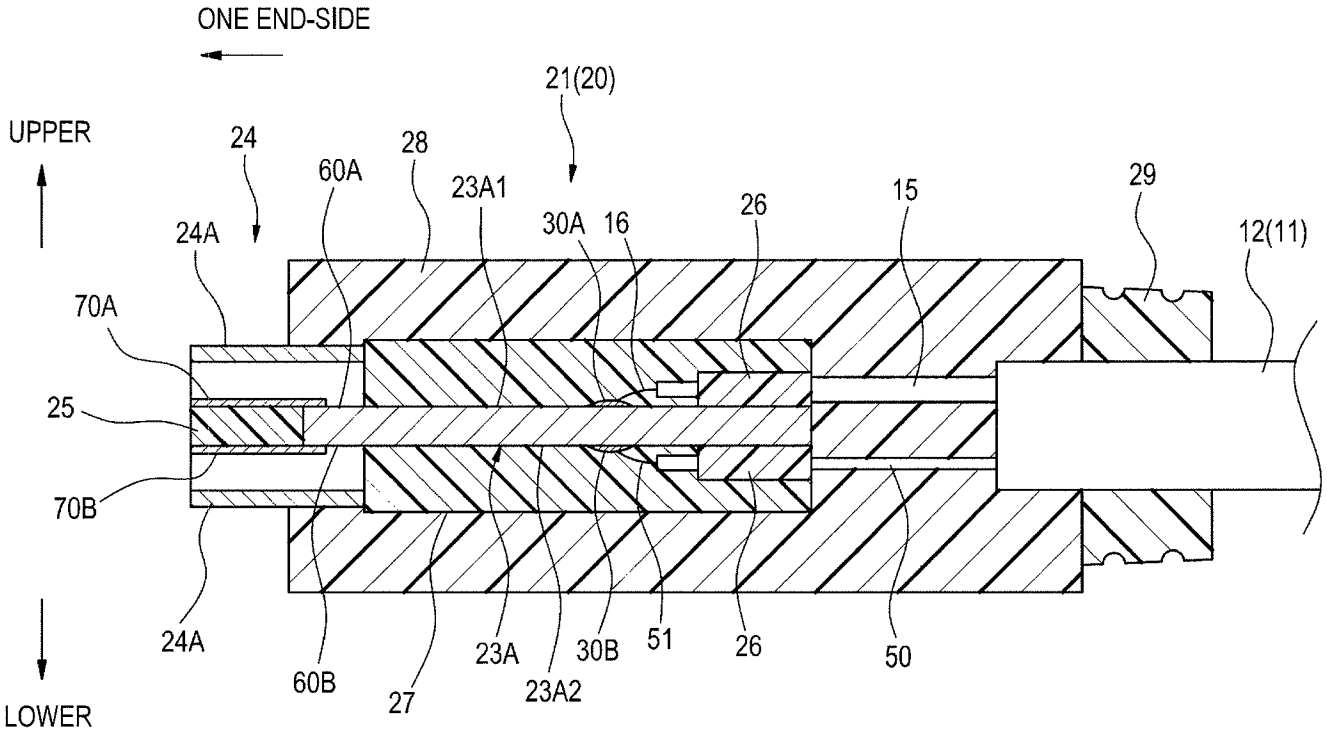
FIG. 3 is a sectional view taken along a line III-III of the cable with connectors shown in FIG. 1.

FIG. 3 is a sectional view taken along a line III-III of the first connector 21 shown in FIG. 1. As shown in FIG. 3, the sheath 12 and the like are removed at an end portion of the cable 11, so that the coaxial electric wire 15 and the insulated electric wire 50 are exposed. The central conductor 16 is exposed at an end portion of the coaxial electric wire 15, and the central conductor 16 is connected to an upper surface-side connection terminal 30A arranged on an upper surface 23A1-side of the first substrate 23A by soldering, for example. Also, the central conductor 51 is exposed at an end portion of the insulated electric wire 50, and the central conductor 51 is connected to a lower surface-side connection terminal 30B arranged on a lower surface 23A2-side of the first substrate 23A by soldering, for example.

The coaxial electric wire 15 with the central conductor 16 being connected to the upper surface-side connection terminal 30A of the first substrate 23A is resin-sealed by a first resin layer 26. Likewise, the insulated electric wire 50 with the central conductor 51 being connected to the lower surface-side connection terminal 30B of the first substrate 23A is also resin-sealed by the first resin layer 26. At a state where the coaxial electric wire 15 and the insulated electric wire 50 are connected to the first substrate 23A, the upper surface 23A1 and lower surface 23A2 of the first substrate 23A and a surrounding of the coaxial electric wire 15 and insulated electric wire 50 are resin-sealed by a second resin layer 27.

The metallic shell 24A configuring the connector plug 24 is arranged at one end-side of the first substrate 23A resin-sealed by the second resin layer 27. The pin holding plate 25 accommodated in the metallic shell 24A has a plurality of contact pins 70A arranged on an upper surface thereof and a plurality of contact pins 70B arranged on a lower surface thereof. An end portion of the pin holding plate 25 opposite to one end-side thereof is connected to the first substrate 23A exposed from the second resin layer 27. The upper surface-side connection terminals 60A of the first substrate 23A and the contact pins 70A on the upper surface of the pin holding plate 25 are electrically connected, and the lower surface-side connection terminals 60B of the first substrate 23A and the contact pins 70B on the lower surface of the pin holding plate 25 are electrically connected.

Also, the first connector 21 is entirely resin-sealed by a third resin layer 28 over a part of the other end-side of the metallic shell 24A, the first substrate 23A and a tip portion of the sheath 12 of the cable 11. One end-side of the metallic shell 24A is exposed from the third resin layer 28, so that it functions as a housing of the connector plug 24. At the other end-side of the third resin layer 28, a strain relief 29 made of resin and configured to reduce stress to the cable 11 covers a surrounding of the sheath 12.

Since the configuration of the second connector 22 is the same as the first connector 21 shown in FIG. 3, except that the second substrate 23B other than the first substrate 23A is accommodated therein, the detailed description and illustration are omitted.

Figure 4B:
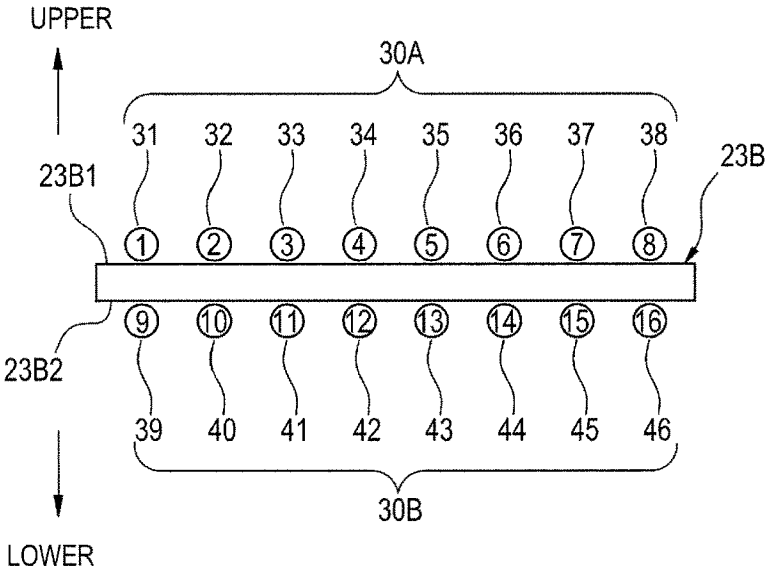
FIG. 4B is a pictorial view depicting a connector substrate provided for a second connector, as seen from the cable-side.
Figure 4A:
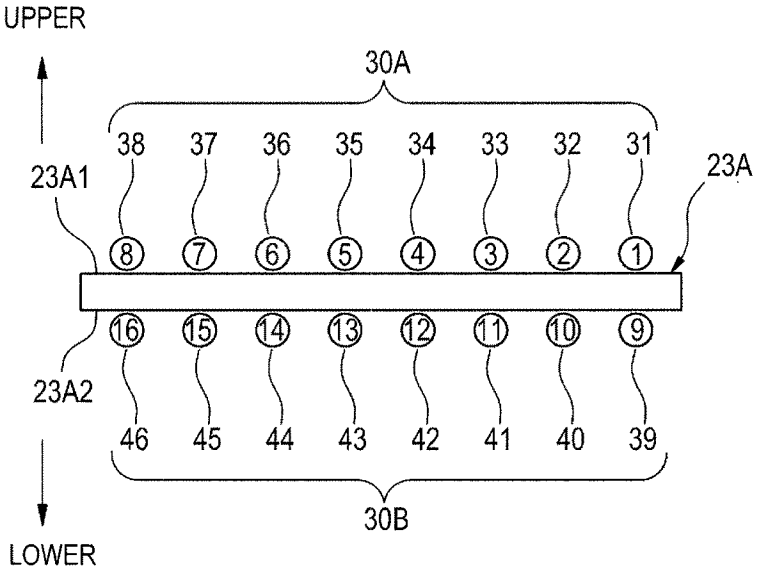
FIG. 4A is a pictorial view depicting a connector substrate provided for a first connector, as seen from the cable-side.

FIG. 4A is a pictorial view depicting the first substrate 23A of the first connector 21, as seen from the cable 11-side, and FIG. 4B is a pictorial view depicting the second substrate 23B of the second connector 22, as seen from the cable 11-side.

As shown in FIG. 4A, when the first substrate 23A of the first connector 21 is seen from the cable 11-side (an arrow A in FIG. 1), a plurality of upper surface-side connection terminals 30A is arranged on the upper surface 23A1 of the first substrate 23A. Specifically, a first connection terminal 31, a second connection terminal 32, a third connection terminal 33, a fourth connection terminal 34, a fifth connection terminal 35, a sixth connection terminal 36, a seventh connection terminal 37 and an eighth connection terminal 38 are arranged in order from right toward left. Also, a plurality of lower surface-side connection terminals 30B is arranged on the lower surface 23A2 of the first substrate 23A. Specifically, like the upper surface-side connection terminals 30A, a ninth connection terminal 39, a tenth connection terminal 40, an eleventh connection terminal 41, a twelfth connection terminal 42, a thirteenth connection terminal 43, a fourteenth connection terminal 44, a fifteenth connection terminal 45, and a sixteenth connection terminal 46 are arranged in order from right toward left.

As shown in FIG. 4B, when the second substrate 23B of the second connector 22 is seen from the cable 11-side (an arrow B in FIG. 1), a plurality of upper surface-side connection terminals 30A is arranged on the upper surface 23B1 of the second substrate 23B. Specifically, contrary to the first substrate 23A, a first connection terminal 31, a second connection terminal 32, a third connection terminal 33, a fourth connection terminal 34, a fifth connection terminal 35, a sixth connection terminal 36, a seventh connection terminal 37 and an eighth connection terminal 38 are arranged in order from left toward right. Also, a plurality of lower surface-side connection terminals 30B is arranged on the lower surface 23B2 of the second substrate 23B. Specifically, contrary to the first substrate 23A, a ninth connection terminal 39, a tenth connection terminal 40, an eleventh connection terminal 41, a twelfth connection terminal 42, a thirteenth connection terminal 43, a fourteenth connection terminal 44, a fifteenth connection terminal 45, and a sixteenth connection terminal 46 are arranged in order from left toward right.

In this way, according to the exemplary embodiment, the arrangement order of the upper surface-side connection terminals 30A and the lower surface-side connection terminals 30B of the first substrate 23A of the first connector 21 at one end-side of the cable 11 and the arrangement order of the upper surface-side connection terminals 30A and the lower surface-side connection terminals 30B of the second substrate 23B of the second connector 22 at the other end-side of the cable 11 are mirror-symmetric with the cable 11 being interposed therebetween.

Figures 5A, 5B:
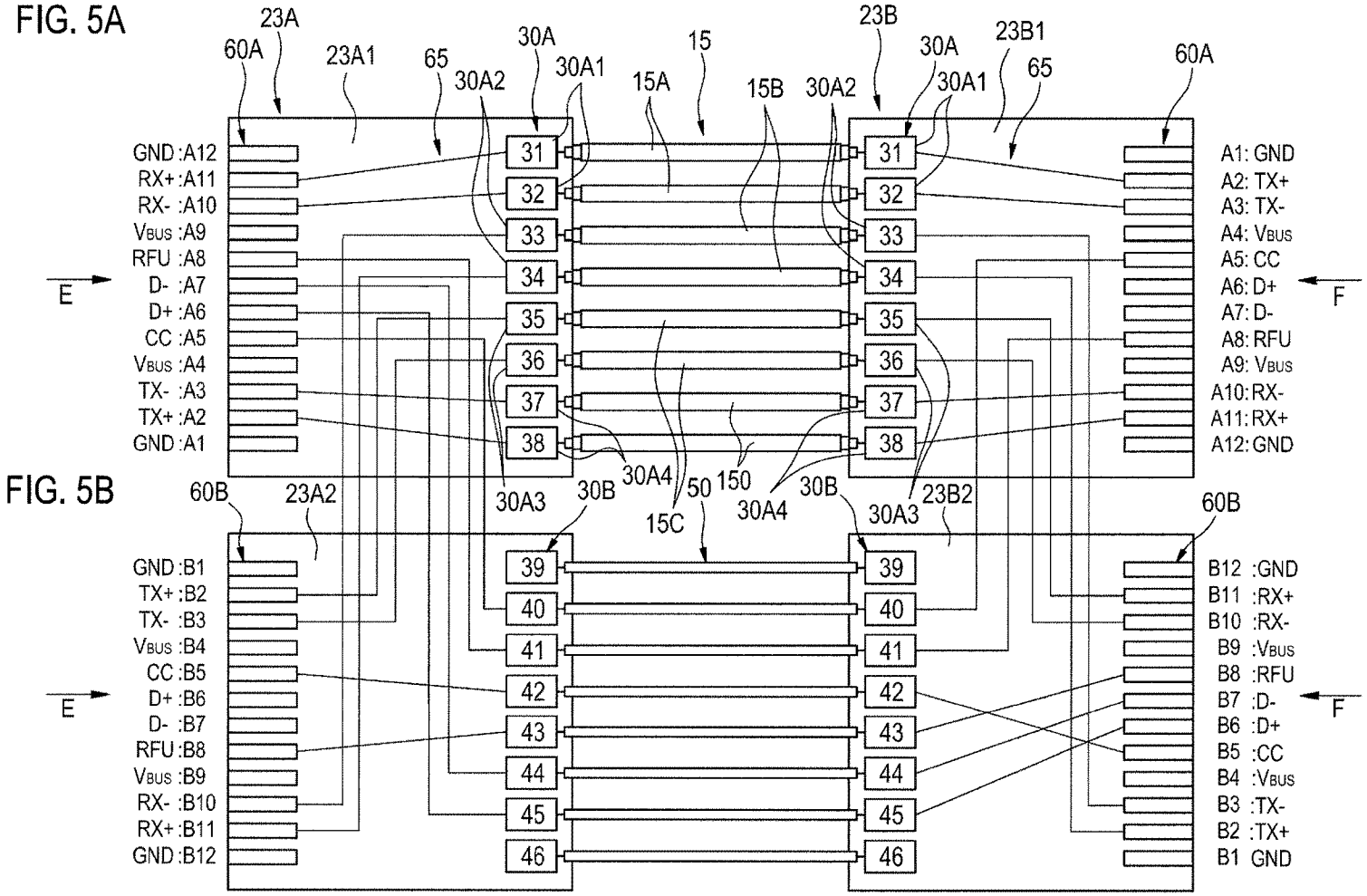
FIG. 5A is a schematic plan view depicting an arrangement example of the upper surface-side connection terminals on the upper surfaces of the first and second substrates.
FIG. 5B is a schematic plan view depicting an arrangement example of the lower surface-side connection terminals on the lower surface of the first and second substrates.

FIG. 5A is a schematic plan view depicting an arrangement example of the upper surface-side connection terminals 30A, 60A on the upper surfaces 23A1, 23B1 of the first and second substrates 23A, 23B, and FIG. 5B is a schematic plan view depicting an arrangement example of the lower surface-side connection terminals 30B, 60B on the lower surface 23A2, 23B2 of the first and second substrates 23A, 23B. FIG. 5A depicts the upper surfaces 23A1, 23B1 when the first substrate 23A and the second substrate 23B are seen from above. Also, FIG. 5B depicts the lower surfaces 23A2, 23B2 when the first substrate 23A and the second substrate 23B are seen from the same direction (upper surface direction) as the upper surfaces 23A1, 23B1 shown in FIG. 5A.

As described above, the eight coaxial electric wires 15 are configured as the coaxial electric wire pairs of which two coaxial electric wires are a pair, so as to transmit the high-speed differential signal, and the first electric wire pair 15A, the second electric wire pair 15B, the third electric wire pair 15C and the fourth electric wire pair 15D are arranged from above toward below in FIG. 5A. Each end of the four coaxial electric wire pairs 15A to 15D is connected to the upper surface-side connection terminals 30A of the first substrate 23A and the upper surface-side connection terminals 30A of the second substrate 23B, respectively, without the intersection of the eight coaxial electric wires 15.

Specifically, in FIG. 5A, the two coaxial electric wires 15 configuring the first electric wire pair 15A arranged at an upper end (a right end in the arrow A in FIG. 1) are respectively connected to the first connection terminals 31 and the second connection terminals 32 of the first substrate 23A and the second substrate 23B. The two coaxial electric wires configuring the second electric wire pair 15B arranged below the first electric wire pair 15A are respectively connected to the third connection terminals 33 and the fourth connection terminals 34 of the first substrate 23A and the second substrate 23B. The third electric wire pair 15C arranged below the second electric wire pair 15B is connected to the fifth connection terminals 35 and the sixth connection terminals 36 of the first substrate 23A and the second substrate 23B. Also, the fourth electric wire pair 15D arranged at a lower end is connected to the seventh connection terminals 37 and the eighth connection terminals 38 of the first substrate 23A and the second substrate 23B.

Also, in the exemplary embodiment, each end of the eight insulated electric wires 50 is connected to the lower surface-side connection terminals 30B (the lower surface-side connection terminals 39 to 46) of the first substrate 23A and the lower surface-side connection terminals 30B (the lower surface-side connection terminals 39 to 46) of the second substrate 23B, respectively, without the intersection of the eight insulated electric wires 50.

In this way, the coaxial electric wires 15, which are the high-speed differential signal wires, are connected to the upper surface-side connection terminals 30A arranged on the upper surfaces 23A1, 23B1 of the first and second substrates 23A, 23B, and the insulated electric wires 50, which are the single-ended signal wires, are connected to the lower surface-side connection terminals 30B arranged on the lower surfaces 23A2, 23B2 of the first and second substrates 23A, 23B. For this reason, in the exemplary embodiment, when connecting the plurality of electric wires 15, 50 to the connection terminals 30A, 30B of the first substrate 23A and the second substrate 23B, it is possible to perform the wiring operation very easily.

On the upper surface 23A1 of the first substrate 23A, a plurality of upper surface-side connection terminals 60A to be connected to the contact pins 70A (refer to FIG. 6) of the upper surface-side is arranged at an opposite side to the connection-side with the cable 11. Specifically, a first connection terminal A1, a second connection terminal A2, a third connection terminal A3, a fourth connection terminal A4, a fifth connection terminal A5, a sixth connection terminal A6, a seventh connection terminal A7, an eighth connection terminal A8, a ninth connection terminal A9, a tenth connection terminal A10, an eleventh connection terminal A11 and a twelfth connection terminal A12 are arranged in order from below toward above in FIG. 5A. That is, when the first substrate 23A is seen from an opposite side to the cable 11 (an arrow E in FIG. 5A), the first connection terminal A1 to the twelfth connection terminal A12 are arranged from right toward left.

Also, on the upper surface 23B1 of the second substrate 23B, the plurality of upper surface-side connection terminals 60A to be connected to the contact pins 70A of the upper surface-side is arranged at an opposite side to the connection-side with the cable 11. Specifically, a first connection terminal A1, a second connection terminal A2, a third connection terminal A3, a fourth connection terminal A4, a fifth connection terminal A5, a sixth connection terminal A6, a seventh connection terminal A7, an eighth connection terminal A8, a ninth connection terminal A9, a tenth connection terminal A10, an eleventh connection terminal A11 and a twelfth connection terminal A12 are arranged in order from above toward below in FIG. 5A. That is, when the second substrate 23B is seen from an opposite side to the cable 11 (an arrow F in FIG. 5A), the first connection terminal A1 to the twelfth connection terminal A12 are arranged from right toward left, like the first substrate 23A.

The first connection terminal A1 and the twelfth connection terminal A12 of the upper surface-side connection terminals 60A are ground terminals (GND) for earth. The second connection terminal A2 and the third connection terminal A3 are terminals for high-speed signal transmission (TX+, TX−). The fourth connection terminal A4 and the ninth connection terminal A9 are terminals for power feeding ($V_{BUS}$). The fifth connection terminal A5 is a terminal for communication control (CC) signal transmission. The sixth connection terminal A6 and the seventh connection terminal A7 are terminals for data signal (D+, D−). The eighth connection terminal A8 is a preliminary terminal (RFU (Revised for Future Use)). The tenth connection terminal A10 and the eleventh connection terminal A11 are terminals for high-speed signal reception (RX+, RX−).

Also, on the lower surface 23A2 of the first substrate 23A, a plurality of lower surface-side connection terminals 60B to be connected to the contact pins 70B (refer to FIG. 6) of the lower surface-side is arranged at an opposite side to the connection-side with the cable 11. Specifically, a first connection terminal B1, a second connection terminal B2, a third connection terminal B3, a fourth connection terminal B4, a fifth connection terminal B5, a sixth connection terminal B6, a seventh connection terminal B7, an eighth connection terminal B8, a ninth connection terminal B9, a tenth connection terminal B10, an eleventh connection terminal B11 and a twelfth connection terminal B12 are arranged in order from above toward below in FIG. 5B. That is, when the first substrate 23A is seen from an opposite side to the cable 11 (an arrow E in FIG. 5A), the first connection terminal B1 to the twelfth connection terminal B12 are arranged from left toward right.

On the lower surface 23B2 of the second substrate 23B, a plurality of lower surface-side connection terminals 60B to be connected to the contact pins 70B of the lower surface-side is arranged at an opposite side to the connection-side with the cable 11. Specifically, a first connection terminal B1, a second connection terminal B2, a third connection terminal B3, a fourth connection terminal B4, a fifth connection terminal B5, a sixth connection terminal B6, a seventh connection terminal B7, an eighth connection terminal B8, a ninth connection terminal B9, a tenth connection terminal B10, an eleventh connection terminal B11 and a twelfth connection terminal B12 are arranged in order from below toward above in FIG. 5B. That is, when the second substrate 23B is seen from an opposite side to the cable 11

(an arrow E in FIG. 5A), the first connection terminal B1 to the twelfth connection terminal B12 are arranged from left toward right, like the first substrate 23A.

The first connection terminal B1 and the twelfth connection terminal B12 of the lower surface-side connection terminals 60B are ground terminals (GND) for earth. The second connection terminal B2 and the third connection terminal B3 are terminals for high-speed signal transmission (TX+, TX−). The fourth connection terminal B4 and the ninth connection terminal B9 are terminals for power feeding ($V_{BUS}$). The fifth connection terminal B5 is a terminal for communication control (CC) signal transmission. The sixth connection terminal B6 and the seventh connection terminal B7 are terminals for data signal (D+, D−). The eighth connection terminal B8 is a preliminary terminal (RFU). The tenth connection terminal B10 and the eleventh connection terminal B11 are terminals for high-speed signal reception (RX+, RX−).

In this way, according to the exemplary embodiment, the connection terminals 60A, 60B at one end-side of the first substrate 23A and the connection terminals 60A, 60B at the other end-side of the second substrate 23B are arranged in the same arrangement order, as seen from the opposite side (the arrows E and F of FIGS. 5A and 5B) to the connection-side with the cable 11.

The upper surface-side connection terminals 30A of the cable 11-side arranged as described above are coupled with the connection terminals 60A, 60B of the contact pins 70A, 70B-side via an electric circuit (conductor) 65, as follows. Herein, the first and second connection terminals 31, 32 to which the first electric wire pair 15A is connected are referred to as a first contact point pair 30A1, the third and fourth connection terminals 31, 32 to which the second electric wire pair 15B is connected are referred to as a second contact point pair 30A2, the fifth and sixth connection terminals 35, 36 to which the third electric wire pair 15C is connected are referred to as a third contact point pair 30A3, and the seventh and eighth connection terminals 37, 38 to which the fourth electric wire pair 15D is connected are referred to as a fourth contact point pair 30A4.

(Example of Coupling Configuration of First Substrate 23A-Side)

First contact point pair 30A1 (the first connection terminal 31 and the second connection terminal 32 of the cable 11-side): the eleventh connection terminal A11 and the tenth connection terminal A10 (the upper surface-side connection terminals 60A) of the contact pins 70A, 70B-side Second contact point pair 30A2 (the third connection terminal 33 and the fourth connection terminal 34 of the cable 11-side): the tenth connection terminal B10 and the eleventh connection terminal B11 (the lower surface-side connection terminals 60B) of the contact pins 70A, 70B-side Third contact point pair 30A3 (the fifth connection terminal 35 and the sixth connection terminal 36 of the cable 11-side): the second connection terminal B2 and the third connection terminal B3 (the lower surface-side connection terminals 60B) of the contact pins 70A, 70B-side Fourth contact point pair 30A4 (the seventh connection terminal 37 and the eighth connection terminal 38 of the cable 11-side): the third connection terminal A3 and the second connection terminal A2 (the upper surface-side connection terminals 60A) of the contact pins 70A, 70B-side (Example of Coupling Configuration of Second Substrate 23B-Side)

First contact point pair 30A1 (the first connection terminal 31 and the second connection terminal 32 of the cable 11-side): the second connection terminal A2 and the third connection terminal A3 (the upper surface-side connection terminals 60A) of the contact pins 70A, 70B-side Second contact point pair 30A2 (the third connection terminal 33 and the fourth connection terminal 34 of the cable 11-side): the third connection terminal B3 and the second connection terminal B2 (the lower surface-side connection terminals 60B) of the contact pins 70A, 70B-side Third contact point pair 30A3 (the fifth connection terminal 35 and the sixth connection terminal 36 of the cable 11-side): the eleventh connection terminal B11 and the tenth connection terminal B11 (the lower surface-side connection terminals 60B) of the contact pins 70A, 70B-side Fourth contact point pair 30A4 (the seventh connection terminal 37 and the eighth connection terminal 38 of the cable 11-side): the tenth connection terminal A10 and the eleventh connection terminal A11 (the upper surface-side connection terminals 60A) of the contact pins 70A, 70B-side As described above, in any of the first and second substrates 23A, 23B, the first contact point pair 30A1 and the fourth contact point pair 30A4 of both ends of the four contact point pairs 30A1 to 30A4 are coupled with the upper surface-side connection terminals 60A arranged on the upper surfaces 23A1, 23A2 of the first and second substrates 23A, 23B via the electric circuit 65. The second contact point pair 30A2 and the third contact point pair 30A3 sandwiched between the contact point pairs 30A1, 30A4 of both ends are coupled with the lower surface-side connection terminals 60B arranged on the lower surfaces 23A2, 23B2 of the first and second substrates 23A, 23B via the electric circuit 65. In this way, according to the exemplary embodiment, the connection destinations (connection terminals 60A, 60B) of the first contact point pair 30A1 to the fourth contact point pair 30A4 of the high-speed differential signal wires 15 are dividedly allotted to the upper and lower surfaces (front surface and back surface) of the substrates 23A, 23B. The connection destinations of the high-speed differential signal wires 15 are dividedly arranged on both surfaces of the substrates 23A, 23B, so that it is possible to manufacture the connectors 20 having a width narrower than a configuration where the connection destinations are arranged on one surface.

Also, the lower surface-side connection terminals 30B arranged on the lower surfaces 23A2, 23B2 of the first and second substrates 23A, 23B and connected to the insulated electric wires 50 are coupled with any one of the ninth connection terminals A9, B9 from the fourth connection terminals A4, B4 arranged between the second connection terminals A2, B2 and third connection terminals A3, B3, which are the connection terminals for high-speed signal transmission (contact points for high-speed signal transmission), and the tenth connection terminals A10, B10 and eleventh connection terminal A11, B10 of the connection terminals 60A, 60B of the contact pins 70A, 70B-side, via the electric circuit 65. That is, in the exemplary embodiment, the connection terminals for high-speed signal (contact points for high-speed signal) A2, A3, A10, A11, B2, B3, B10, B11 are arranged with the connection terminals for single-ended signal (contact points for single-ended signal) A4 to A9, B4 to B9 being interposed therebetween. In this way, according to the exemplary embodiment, since the contact points for high-speed signal are apart arranged, it is possible to suppress the crosstalk therebetween.

Figure 6:
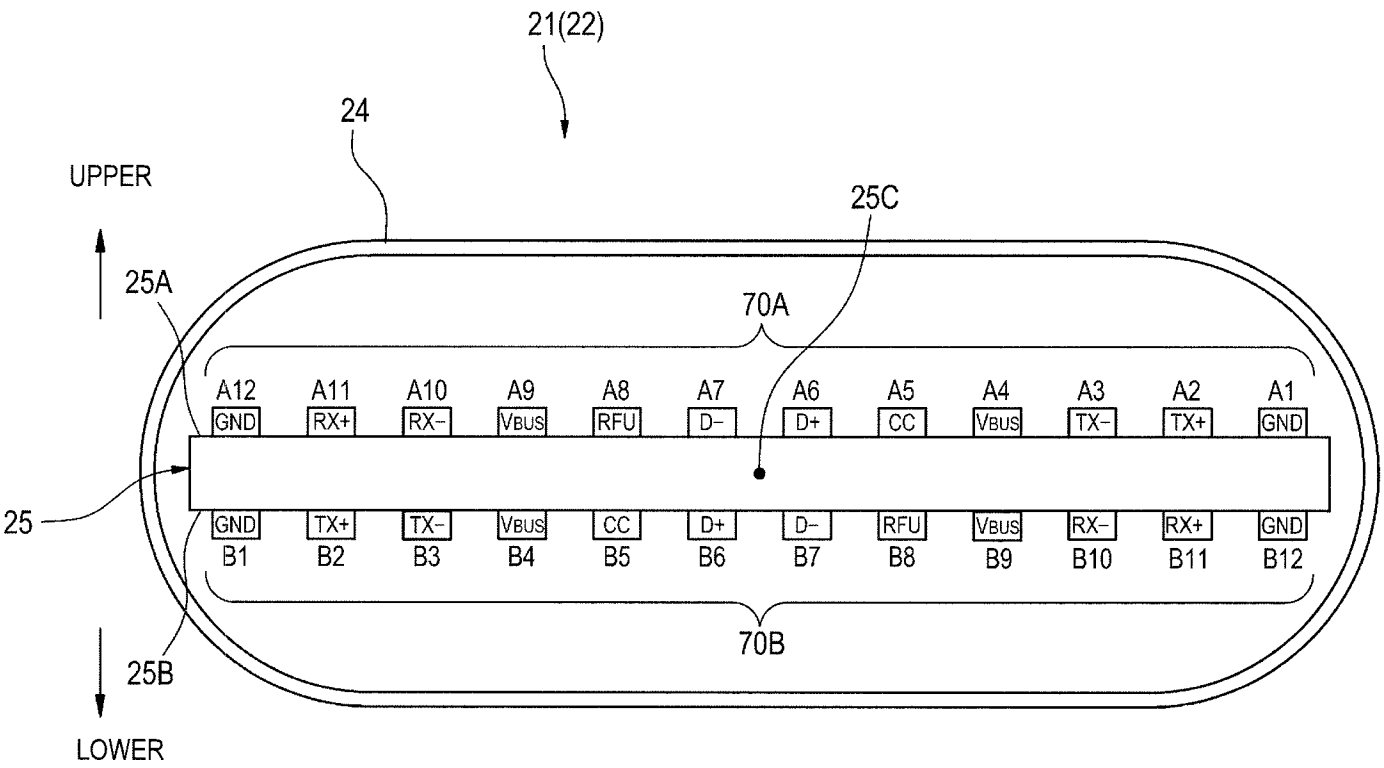
FIG. 6 is a front view depicting a plug tip portion opposite to a cable connection part of the first connector and the second connector.

FIG. 6 is a front view depicting a tip portion of the connector plug 24 of the first connector 21. As described above, the contact pins 70A, 70B provided on the pin holding plate 25 are connected to the connection terminals 60A, 60B of the first substrate 23A. For this reason, as shown in FIG. 6, the arrangement order of the contact pins 70A, 70B is the same as the arrangement order of the connection terminals 60A, 60B of the first substrate 23A shown in FIGS. 5A and 5B.

That is, when the connector plug 24 is seen from an opposite side to the cable 11 (an arrow C in FIG. 1), a first contact pin A1 (GND), a second contact pin A2 (TX+), a third contact pin A3 (TX−), a fourth contact pin A4 ($V_{BUS}$), a fifth contact pin A5 (CC), a sixth contact pin A6 (D+), a seventh contact pin A7 (D−), an eighth contact pin A8 (RFU), a ninth contact pin A9 ($V_{BUS}$), a tenth contact pin A10 (RX−), an eleventh contact pin A11 (RX+) and a twelfth contact pin A12 (GND) are arranged in order from right toward left on the upper surface 25A of the pin holding plate 25.

Also, on the lower surface 25B of the pin holding plate 25, a first contact pin B1 (GND), a second contact pin B2 (TX+), a third contact pin B3 (TX−), a fourth contact pin B4 ($V_{BUS}$), a fifth contact pin B5 (CC), a sixth contact pin B6 (D+), a seventh contact pin B7 (D−), an eighth contact pin B8 (RFU), a ninth contact pin B9 ($V_{BUS}$), a tenth contact pin B10 (RX−), an eleventh contact pin B11 (RX+) and a twelfth contact pin B12 (GND) are arranged from left toward right in reverse order to the arrangement order of the contact pins 70A on the upper surface-side.

In this way, the plurality of upper surface-side contact pins 70A and the plurality of lower surface-side contact pins 70B provided for the pin holding plate 25 are arranged so that the arrangement order of the upper surface-side the contact pins 70A and the arrangement order of the lower surface-side the contact pins 70B are point-symmetric with respect to a virtual center 25C of the pin holding plate 25. Thereby, the first connector 21 can be inserted into a receptacle, which is the connection destination, without distinction of the upper and lower sides (top and bottom).

Also in the connector plug 24 of the second connector 22, the arrangement order of the upper surface-side contact pins 70A and the lower surface-side contact pins 70B are the same as the contact pins 70A, 70B provided for the connector plug 24 of the first connector 21 shown in FIG. 6. That is, when the connector plug 24 provided for the second connector 22 is seen from an opposite side to the cable 11 (an arrow D in FIG. 1), a first contact pin A1 to a twelfth contact pin A12 are arranged on the upper surface 25A of the pin holding plate 25 in order from right toward left, and a first contact pin B1 to a twelfth contact pin B12 are arranged on the lower surface 25B of the pin holding plate 25 from left toward right in reverse order to the arrangement order of the upper surface-side contact pins 70A. Thereby, the second connector 22 can also be inserted into the receptacle, without distinction of the upper and lower sides (top and bottom), like the first connector 21. Also, since it is possible to use the same connector plug 24, which is to be respectively connected to the first substrate 23A and the second substrate 23B, it is possible to connect the first connector 21 and the second connector 22 to the receptacles having the same configuration, without distinction of one end-side and the other end-side.

According to the cable 10 having connectors of the exemplary embodiment, the connection terminals 30A, 30B of the first and second substrates 23A, 23B facing toward the cable 11 are arranged so that the arrangement order of the connection terminals 30A, 30B of the first substrate 23A and the arrangement order of the connection terminals 30A, 30B of the second substrate 23B are mirror-symmetric with the electric wires 15, 50 being interposed therebetween. Therefore, when connecting both ends of the electric wires 15, 50 to the first substrate 23A and the second substrate 23B, it is not necessary to wire the electric wires 15, 50 with intersecting the same. For this reason, it is possible to provide the cable 10 having connectors, which can be easily manufactured and the productivity thereof is improved. Also, according to the exemplary embodiment, since there is no wire length difference between the plurality of coaxial electric wires 15, it is possible to prevent the skew from being generated in each of the electric wire pairs 15A to 15D configured to perform differential signal transmission.

Although the invention has been described with reference to the exemplary embodiment, the technical scope of the invention is not limited to the exemplary embodiment. That is, it is obvious to one skilled in the art that a variety of changes or improvements to the exemplary embodiment can be made.

For example, in the cable 10 having connectors of the exemplary embodiment, the connector plug 24 of the first connector 21 and the connector plug 24 of the second connector 22, which are attached to both ends of the cable 11, have the same shape. However, the invention is not limited thereto. For example, the first connector 21 and the second connector 22 of which the connector plugs provided at both ends have different shapes may be attached to both ends of the electric wires 15, 50 inasmuch as the first connector 21 and the second connector 22 can be connected not to intersect the electric wires 15, 50 accommodated in the cable 11.

What is claimed is:

1. A cable with connectors comprising:

a plurality of electric wires arranged in parallel; and a first connector and a second connector provided at each end of the plurality of electric wires, respectively, wherein the first connector comprises a first substrate accommodated therein and a connector plug connected to the first substrate, wherein the second connector comprises a second substrate accommodated therein and a connector plug connected to the second substrate, wherein the first substrate and the second substrate have a plurality of first contact points arranged at one end-side thereof and to be connected with the plurality of electric wires, respectively, wherein the plurality of first contact points is arranged so that the plurality of first contact points provided on the first substrate and the plurality of first contact points provided on the second substrate are respectively arranged in an order so as to be mirror-symmetric with the plurality of electric wires being interposed therebetween, wherein the first substrate and the second substrate have a plurality of second contact points arranged at the other end-side thereof and to be connected with a plurality of contact pins provided for the connector plugs, respectively, wherein the plurality of first contact points and the plurality of second contact points are coupled therebetween by an electric circuit, wherein when the first substrate and the second substrate are seen from sides opposite to sides to which the plurality of electric wires is to be connected, the plurality of second contact points is arranged so that the plurality of second contact points of the first substrate and the plurality of second contact points of the second substrate are respectively arranged in the same order, wherein the plurality of electric wires comprises high-speed differential signal wires configured to transmit and receive a high-speed differential signal and single-ended signal wires configured to transmit and receive a single-ended signal, wherein the single-ended signal wires are connected to a part of the first contact points, which are arranged on a surface of the first substrate and on a surface of the second substrate, and the high-speed differential signal wires are connected to the rest of the first contact points arranged on the other surface of the first substrate and on the other surface of the second substrate, and wherein the high-speed differential signal wires are connected to only one surface of the first substrate and only one surface of the second substrate.

2. The cable with connectors according to claim 1, wherein the high-speed differential signal wires are coaxial electric wires.

3. The cable with connectors according to claim 1, wherein the first contact points arranged on the other surface and connected to the high-speed differential signal wires comprise at least three contact point pairs, wherein the plurality of second contact points comprises contact points for single-ended signal to be connected to the single-ended signal wires and contact points for high-speed signal to be connected to the high-speed differential signal wires, and wherein two contact point pairs of both ends of the at least three contact point pairs are coupled with the contact points for high-speed signal, which are arranged on a surface or the other surface of the first substrate and the second substrate, via an electric circuit, at least one contact point pair sandwiched between the contact point pairs of both ends is coupled with the contact points for high-speed signal arranged on a surface opposite to a surface on which the contact points for high-speed signal connected to the contact point pairs of both ends are arranged, via the electric circuit.

4. The cable with connectors according to claim 3, wherein the plurality of contact points for high-speed signal configures pairs in correspondence to the contact point pairs of the first contact points and the contact points for single-ended signal are sandwiched between the pairs of the contact points for high-speed signal.

5. The cable with connectors according to claim 4, wherein the high-speed differential signal wires are coaxial electric wires.

6. The cable with connectors according to claim 3, wherein the high-speed differential signal wires are coaxial electric wires.

* * * * *